US008622766B2

(12) United States Patent
Yokoo et al.

(10) Patent No.: US 8,622,766 B2
(45) Date of Patent: Jan. 7, 2014

(54) CONNECTOR

(75) Inventors: Hiroyuki Yokoo, Tokyo (JP); Nobukazu Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 41 days.

(21) Appl. No.: 13/499,591

(22) PCT Filed: Sep. 29, 2010

(86) PCT No.: PCT/JP2010/066923

§ 371 (c)(1),
(2), (4) Date: Mar. 30, 2012

(87) PCT Pub. No.: WO2011/040448

PCT Pub. Date: Apr. 7, 2011

(65) Prior Publication Data

US 2012/0178278 A1 Jul. 12, 2012

(30) Foreign Application Priority Data

Oct. 1, 2009 (JP) ..... 2009-230009

(51) Int. Cl.
*H01R 12/24* (2006.01)

(52) U.S. Cl.
USPC ..... 439/495; 439/260

(58) Field of Classification Search
USPC ..... 439/260, 492, 493, 497, 499, 495
See application file for complete search history.

(56) References Cited

U.S. PATENT DOCUMENTS 5,738,545 A 4/1998 Igarashi et al.
7,052,300 B2 * 5/2006 Okita et al. ..... 439/260
7,077,691 B2 * 7/2006 Yokoo et al. ..... 439/495
7,172,445 B2 2/2007 Shimoyama
7,275,954 B2 * 10/2007 Ikenaga et al. ..... 439/494

(Continued)

FOREIGN PATENT DOCUMENTS

JP 9-232039 A 9/1997
JP 2006-73206 A 3/2006

(Continued)

OTHER PUBLICATIONS

Korean Office Action dated Mar. 27, 2013 (and English translation thereof) in counterpart Korean Application No. 10-2012-7007688.

(Continued)

*Primary Examiner* — Ross Gushi
(74) *Attorney, Agent, or Firm* — Holtz, Holtz, Goodman & Chick, PC

(57) ABSTRACT

A connector includes a housing in which a stationary separator portion and an accommodation portion are provided. The accommodation portion receives an actuator above the separator portion and receives an end of an FPC/FFC below the separator portion. A force receiving portion and a contact portion of a contact, which together have a bifurcated shape, are disposed above and below the separator portion, respectively. When the force receiving portion is moved upward by a turning operation of the actuator above the separator portion, the contact portion is abutted with a signal layer of the FPC/FFC, and the position of a ground member which holds the FPC/FFC in conjunction with the contact portion and the position of the separator portion are not changed. Accordingly, the contact between the contact portion and the single layer is stabilized, thereby improving the reliability of the contact between the contact portion of the contact and the FPC/FFC.

6 Claims, 6 Drawing Sheets

(56) References Cited

U.S. PATENT DOCUMENTS

| | | | | |
|---|---|---|---|---|
| 7,695,295 | B2 * | 4/2010 | Hanyu | 439/153 |
| 7,695,299 | B2 * | 4/2010 | Tanaka et al. | 439/259 |
| 8,177,570 | B2 * | 5/2012 | Tanaka et al. | 439/259 |
| 2005/0118849 | A1 * | 6/2005 | Okita et al. | 439/260 |
| 2006/0094288 | A1 * | 5/2006 | Yokoo et al. | 439/495 |
| 2010/0130044 | A1 | 5/2010 | Taketomi | |
| 2011/0021055 | A1 * | 1/2011 | Yokoo et al. | 439/329 |
| 2011/0028018 | A1 * | 2/2011 | Yokoo et al. | 439/329 |
| 2012/0045919 | A1 * | 2/2012 | Yokoo | 439/345 |
| 2012/0178278 | A1 * | 7/2012 | Yokoo et al. | 439/345 |
| 2013/0109218 | A1 * | 5/2013 | Yokoo | 439/345 |

FOREIGN PATENT DOCUMENTS

| | | | |
|---|---|---|---|
| JP | 2006-120429 | A | 5/2006 |
| JP | 2006-128018 | A | 5/2006 |
| JP | 2006-190596 | A | 7/2006 |
| JP | 2007-265911 | A | 10/2007 |
| JP | 2008-117553 | A | 5/2008 |

OTHER PUBLICATIONS

International Search Report dated Nov. 2, 2010 issued in International Appln. No. PCT/JP2010/066923.

* cited by examiner

CONNECTOR

This application is a U.S. National Phase Application under 35 USC 371 of International Application PCT/JP2010/066923 filed Sep. 29, 2010.

TECHNICAL FIELD

This invention relates to a connector to be connected with an FPC (Flexible Printed Circuit) or FFC (Flexible Flat Cable).

BACKGROUND ART

This kind of connectors are disclosed in, for example, Patent Document 1 to Patent Document 3. In each of the connectors of Patent Document 1 to Patent Document 3, an actuator pushes an FPC/FFC down so that the FPC/FFC is brought into contact with a contact portion of a contact.

PRIOR ART DOCUMENTS

Patent Documents

Patent Document 1: JPA 2006-120429
Patent Document 2: JPA 2006-73206
Patent Document 3: JPA H9-232039

SUMMARY OF THE INVENTION

Problems to be Solved by the Invention

In the connectors of Patent Document 1 to Patent Document 3, an FPC/FFC has a top side and a bottom side. The top side is brought into contact with a contact portion. An actuator applies stress to the bottom side of the FPC/FFC. This structure has a problem that contact reliability between the contact portion of the contact and the FPC/FFC is low.

It is therefore an object of the present invention to provide a connector which improves contact reliability between the contact portion of the contact and the FPC/FFC.

Means for Solving the Problems

One aspect of the present invention provides a connector comprising an accommodation portion, a plurality of contacts, a housing and an actuator, the accommodation portion accommodating an end portion of a connection object, each of the plurality of contacts comprising a contact portion, a force receiving portion, a support portion and a fixed portion, the contact portion being positioned in the accommodation portion, the force receiving portion forming a bifurcated shape (fork shape) together with the contact portion the support portion elastically supporting a boundary part between the contact portion and the force receiving portion, the fixed portion being connected with the support portion, the contact portion, the force receiving portion and the support portion being deformable and displaceable in an up-down direction perpendicular to an insertion direction of the connection object, the housing comprising a separator portion, holding the actuator and arranging the plurality of contacts in a left-right direction perpendicular to the insertion direction and the up-down direction by holding each of the fixed portions of the plurality of contacts, the separator portion being positioned between the contact portion and the force receiving portion and constituting a part of the accommodation portion, the actuator comprising a lift portion and being rotatable between a first rotation position and a second rotation position, the lift portion being positioned between the separator portion and the force receiving portion in the up-down direction, when the actuator is rotated from the first rotation position to the second rotation position, the lift portion lifting the force receiving portion so that the contact portion is pushed against a bottom surface of the end portion of the accommodated connection object.

Effect of Invention

According to the present invention, a portion other than the contact portion in the contact is displaced by rotation operation of the actuator. This displacement is transmitted to the contact portion so that the contact portion of the contact is displaced. In addition, positional relation between the separator portion and the connector of the present invention is fixed so that force is not transmitted from the actuator to an FPC/FFC even when the actuator is rotated. In other words, the actuator of the present invention does not push the FPC/FFC against the contact portion of the contact but pushes the contact portion of the contact against the FPC/FFC. With this structure, contact reliability between the contact portion of the contact and the FPC/FFC is improved.

MODES FOR CARRYING OUT THE INVENTION

Hereinafter, embodiments of the present invention will be explained in detail with reference to the drawings.

First Embodiment

Figure 1:
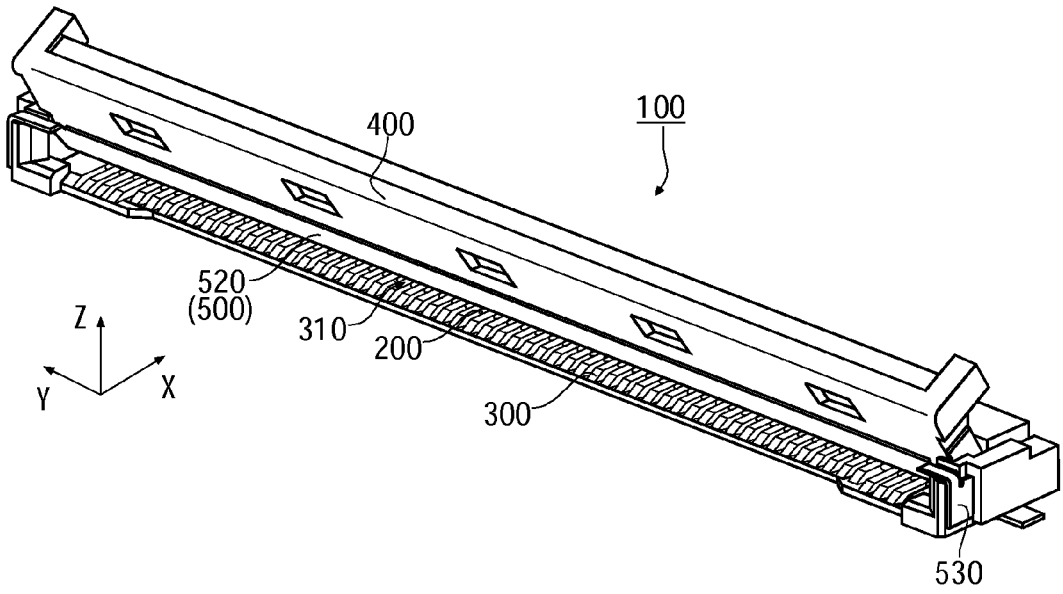
FIG. 1 A front side oblique view showing a connector according to a first embodiment of the present invention.
Figure 2:
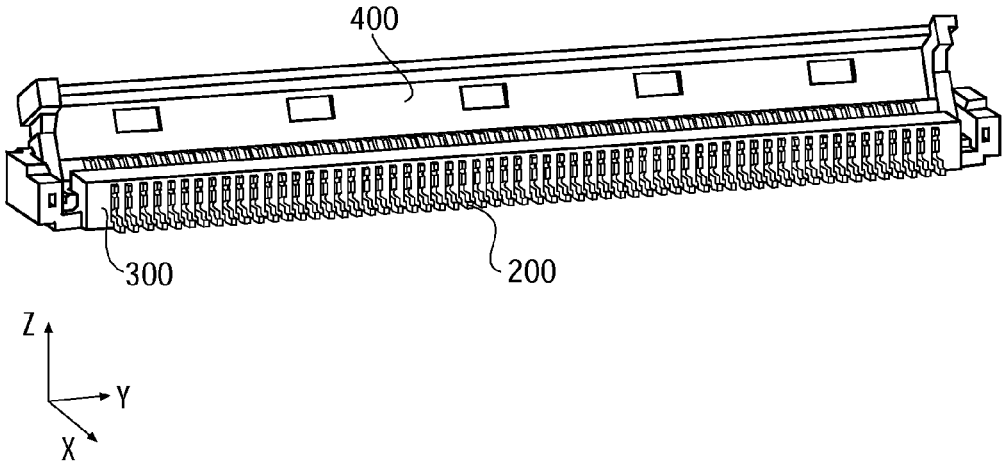
FIG. 2 A back side oblique view showing the connector of FIG. 1. The illustrated connector is not installed with a ground member.
Figure 3:
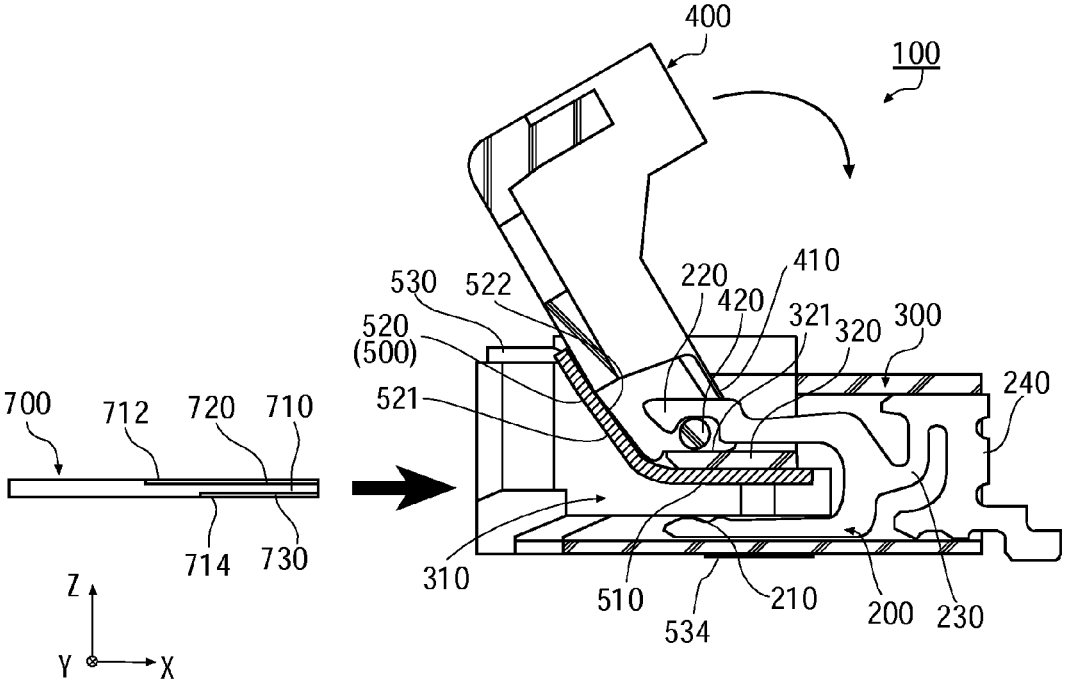
FIG. 3 A cross-sectional view showing the connector of FIG. 1. The actuator is positioned at a first rotation position.
Figure 4:
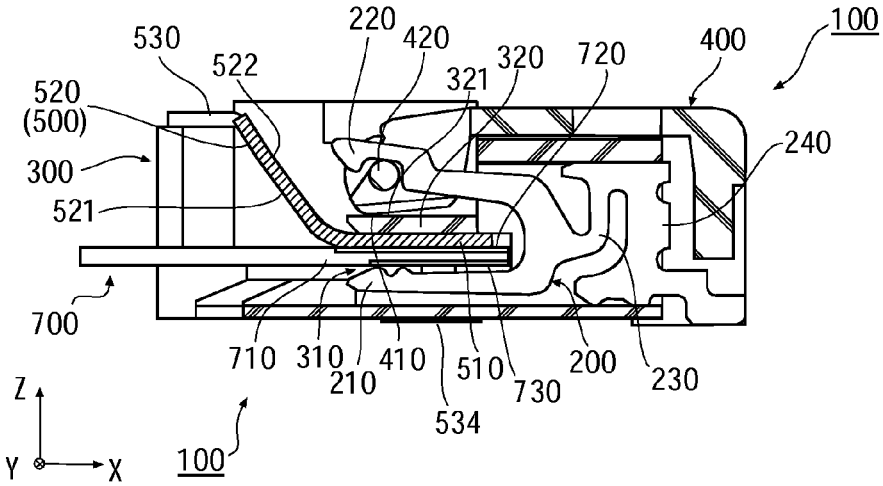
FIG. 4 A cross-sectional view showing the connector of FIG. 1. The actuator is positioned at a second rotation position.
Figure 5:
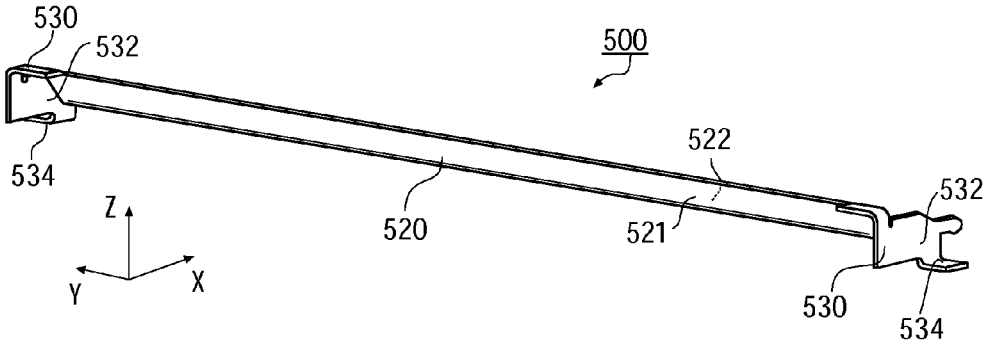
FIG. 5 A front side oblique view showing a ground member included in the connector of FIG. 1.
Figure 6:
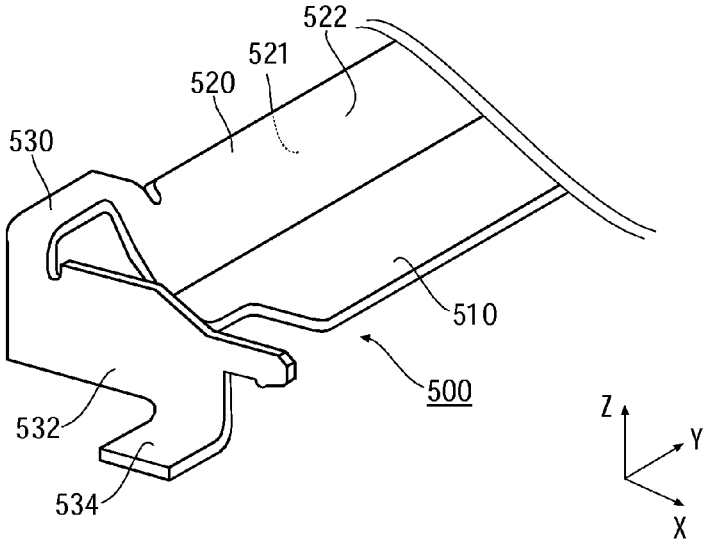
FIG. 6 A back side enlarged oblique view showing an enlarged part of the ground member of FIG. 5.

With reference to FIG. 1, FIG. 3 and FIG. 4, a connection object of a connector 100 according to a first embodiment of the present invention is an FPC/FFC 700. As illustrated in FIG. 3 and FIG. 4, the FPC/FFC has an end portion 710. A top surface 712 of the end portion 710 is formed with a ground layer 720. A bottom surface 714 of the end portion 710 is formed with a signal layer 730.

As illustrated in FIG. 1 to FIG. 4, the connector 100 comprises a plurality of contacts 200, a housing 300, an actuator 400 and a ground member 500. The plurality of contacts 200 is made of conductive material. The housing 300 is made of insulative material which arranges the contacts 200 in a Y-direction (a left-right direction). The actuator 400 is made of insulative material and held by the housing 300 so as to be rotatable. The ground member 500 is made of conductive material and held by the housing 300.

As illustrated in FIG. 3 and FIG. 4, the contact 200 comprises a contact portion 210, a force receiving portion 220, a support portion 230 and fixed portion 240. The contact portion 210 is configured to be brought into contact with the signal layer 730. The force receiving portion 220 forms a bifurcated shape (for example, an U-like shape or a V-like shape) together with the contact portion 210. The support portion 230 elastically supports a boundary part between the contact portion 210 and the force receiving portion 220. The fixed portion 240 is connected with the support portion 230.

As illustrated in FIG. 3 and FIG. 4, the housing 300 comprises an accommodation portion 310. The accommodation portion 310 accommodates the end portion 710 of the FPC/FFC 700 along an X-direction (a front-back direction). The housing 300 is formed with a separator portion 320. The separator portion 320 forms a boundary between two areas. One of the areas is an allowable area which partially receives the actuator 400 and allows the rotation of the actuator 400 to rotate. The other area is the accommodation portion 310. In other words, two areas, i.e. the allowable area and the accommodation portion 310 exist in the housing 300. The separator portion 320 of the present invention defines a part (an upper side) of the accommodation portion 310. In detail, the separator portion 320 is the plate-like part which extends in the Y-direction. The Y-direction is a longitudinal direction of the plate-like part. The separator portion 320 is provided so as to be parallel to the X-direction. Positional relation between the separator portion 320 and the connector 100 of the present embodiment is fixed. In other words, a position of the separator portion 320 does not change in the connector 100.

The contact 200 is inserted into the housing 300 from a back-end side of the housing 300. As illustrated in FIG. 3, the fixed portion 240 is a rear part of the contact 200. The fixed portion 240 is press-fitted into the housing 300 so that the contact 200 is fixed to the housing 300. The contact portion 210 of the contact 200 is positioned in the accommodation portion 310. The force receiving portion 220 is positioned in the above-described allowable area. In other words, the separator portion 320 is positioned between the contact portion 210 and the force receiving portion 220 in a Z-direction (an up-down direction). Parts other than the fixed portion 240 in the contact 200, i.e., the parts of the contact portion 210, the force receiving portion 220 and the support portion 230, are not fixed to the housing 300 so as to be displaceable to some extent in the housing 300. In detail, the contact portion 210, the force receiving portion 220 and the support portion 230 are deformable and/or displaceable in an XZ-plane (including X-direction and −X-direction).

The actuator 400 of the present embodiment is rotatable between a first rotation position (see FIG. 3) and a second rotation position (see FIG. 4). The actuator 400 comprises a push portion 410 and a lift portion 420. The lift portion 420 is positioned between the separator portion 320 and the force receiving portion 220 of the contact 200 in the up-down direction. A top surface of the separator portion 320 serves as a pushed surface 321. The push portion 410 pushes the pushed portion 321 of the separator portion 320 when the actuator 400 is rotated from the first rotation position to the second rotation position. The separator portion 320 is fixed to the housing 300 and does not move. Thus, the push portion 410 receives reaction force by the pushed surface 321 when the push portion 410 pushes the pushed surface 321. The lift portion 420 is moved upward. The force receiving portion 220 of the contact 200 is lifted upward as a result of the lift portion 420 being moved upward. The contact portion 210 is displaced upward as a result of the force receiving portion 220 being lifted upward. Therefore, when the end portion of the FPC/FFC 700 is accommodated in the accommodation portion 310, the contact portion 210 is pushed against the signal layer 730. As explained above, the electrical contact between the contact portion 210 and the signal layer 730 is made by a rotation operation of the actuator 400.

As illustrated in FIG. 1 and FIG. 3 to FIG. 6, the ground member 500 of the present embodiment comprises a plate-like portion 510, an actuator-receiving portion 520 and end portions 530. The plate-like portion 510 extends in parallel with an XY-plane. The actuator-receiving portion 520 extends obliquely to the X-direction and the direction from the plate-like portion 510. The end portions 530 are provided on both left and right ends of the actuator-receiving portion 520. The end portion 530 is provided with a press-fit portion 532 and a hold down 534. The press-fit portions 532 are press-fitted into both end portions of the housing 300 so that the ground member 500 is attached to the housing 300. As illustrated in FIG. 3 and FIG. 4, the plate-like portion 510 is arranged under the separator portion 320. In other words, the plate-like portion 510 of the present embodiment is positioned in the accommodation portion 310. As illustrated in FIG. 3 and FIG. 4, the actuator-receiving portion 520 comprises a front side part 521 and a rear side part 522. The rear side part 522 receives the actuator 400 positioned at the first rotation position. The front side part 521 guides the end portion 710 of the FPC/FFC 700 into the accommodation portion 310. In detail, when the actuator 400 is positioned at the first rotation position, the end portion 710 of the FPC/FFC 700 is guided under the plate-like portion 510 by the front side part 521 and inserted in the accommodation portion 310. In the present embodiment, the end portion 710 accommodated in the accommodation portion 310 is positioned between the plate-like portion 510 of the ground member 500 and the contact portion 210 of the contact 200. When the end, portion 710 is accommodated in the accommodation portion 310, the actuator 400 is rotated so that the contact portion 210 is pushed against the signal layer 730. Accordingly, the ground layer 720 of the FPC/FFC 700 is pushed against the plate-like portion 510 of the ground member 500, and the plate-like portion 510 is pushed against the separator portion 320. The plate-like portion 510 is sandwiched between the ground layer 720 and the separator portion 320. The plate-like portion 510 is electrically connected with the ground layer 720. In this state, connection between the plate-like portion 510 and the ground layer 720 is surface contact so that the ground layer 720 is not scraped by the plate-like portion 510. In addition, similar to the separator portion 320, the plate-like portion 510 is principally a fixed part in the connector 100. In other words, positional relation between the plate-like portion 510 and the connector 100 is principally fixed. Thus, the contact portion 210 is hardly slid off the signal layer 730. In other words, contact between the signal layer 730 and the contact portion 210 does not become unstable. As a result, stable contact between the signal layer 730 and the contact portion 210 can be obtained in this embodiment.

Figure 7:
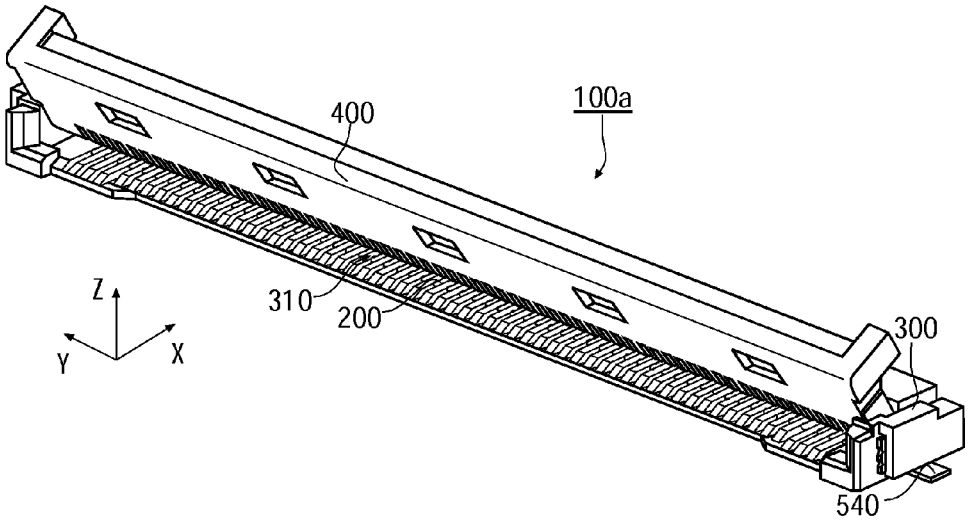
FIG. 7 A front side oblique view showing an example of variation of the connector of FIG. 1.

The plate-like portion of the ground member 500 may be omitted in the case where the FPC/FFC 700 does not have the ground layer 720. For example, a connector 100*a* illustrated in FIG. 7 comprises only hold downs 540 instead of the ground member 500. In detail, the hold down 540 of the connector 100*a* of FIG. 7 has the press-fit portion 532 and the hold down 534 of the ground member 500 illustrated in FIG. 6. The hold down 540 does not have either the plate-like portion 510 or the actuator-receiving portion 520 of the ground member 500 of FIG. 6. When the actuator 400 is brought into the rotation operation in the state that the end portion 710 of the FPC/FFC 700 is accommodated in the accommodation portion 310, the contact portion 210 is pushed against the signal layer 730 and lifts the FPC/FFC 700. The end portion 710 of the FPC/FFC 700 is sandwiched between the contact portion 210 and the separator portion 320. In this embodiment, the positional relation between the separator portion 320 and the connector 100 is fixed. As a result, the stable contact between the signal layer 730 and the contact portion 210.

Second Embodiment

With reference to FIG. 8 to FIG. 11, a connector 100*b* according to the second embodiment of the present invention is an example of variation of the above-described first embodiment. Hereinbelow, an explanation will be made only about differences between the connector 100 of the first embodiment and the connector 100*b* of the second embodiment and, therefore, the explanation of common structure between them will be omitted.

Figure 8:
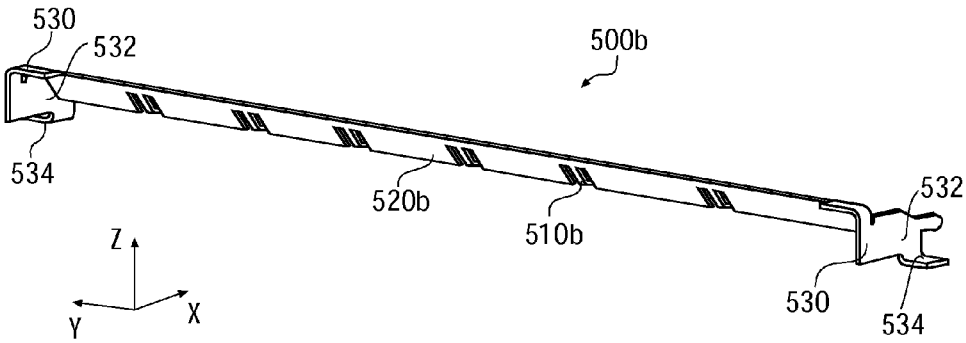
FIG. 8 A front side oblique view showing a ground member included in a connector according to a second embodiment of the present invention.
Figure 9:
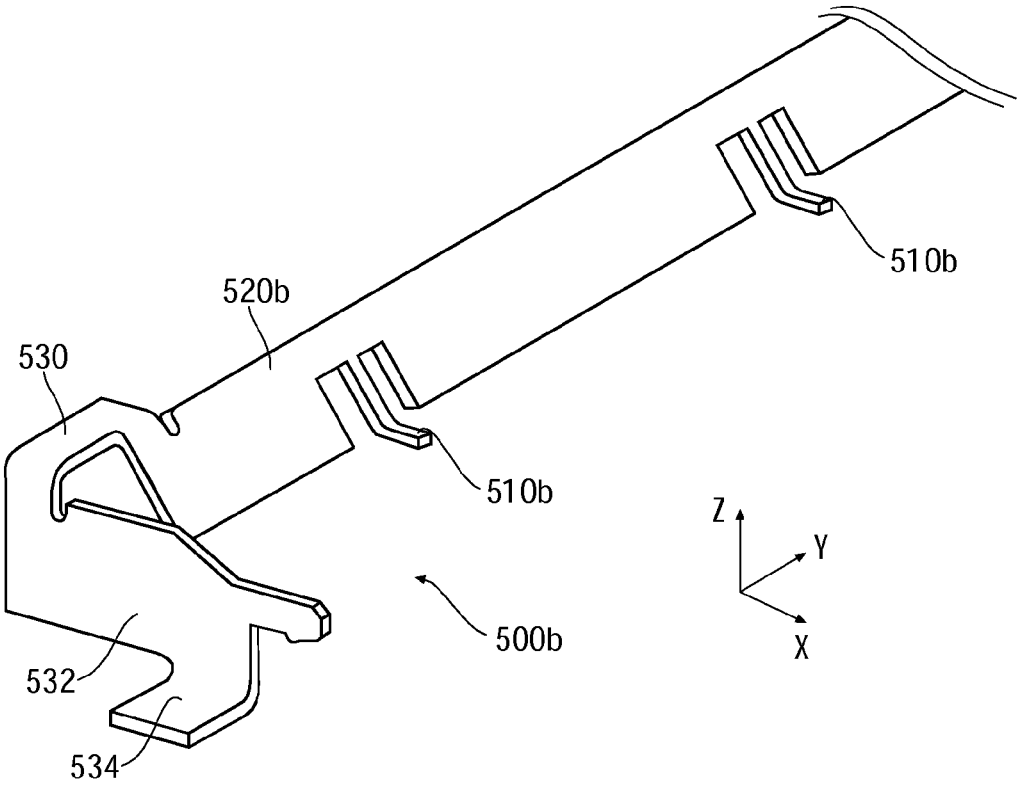
FIG. 9 A back side enlarged oblique view showing an enlarged part of the ground member of FIG. 8.

The connector 100*b* according to this embodiment comprises the ground member 500*b* illustrated in FIG. 8 and FIG. 9 instead of the ground member 500 of the connector 100 according to the first embodiment. The ground member 500*b* of the embodiment comprises a plurality of ground contacts 510*b* instead of the plate-like portion 510. These ground contacts 510*b* are provided with a space therebetween in the Y-direction. The ground contacts 510*b* are elastically supported by the ground member 500*b* so as to be displaceable.

Figure 10:
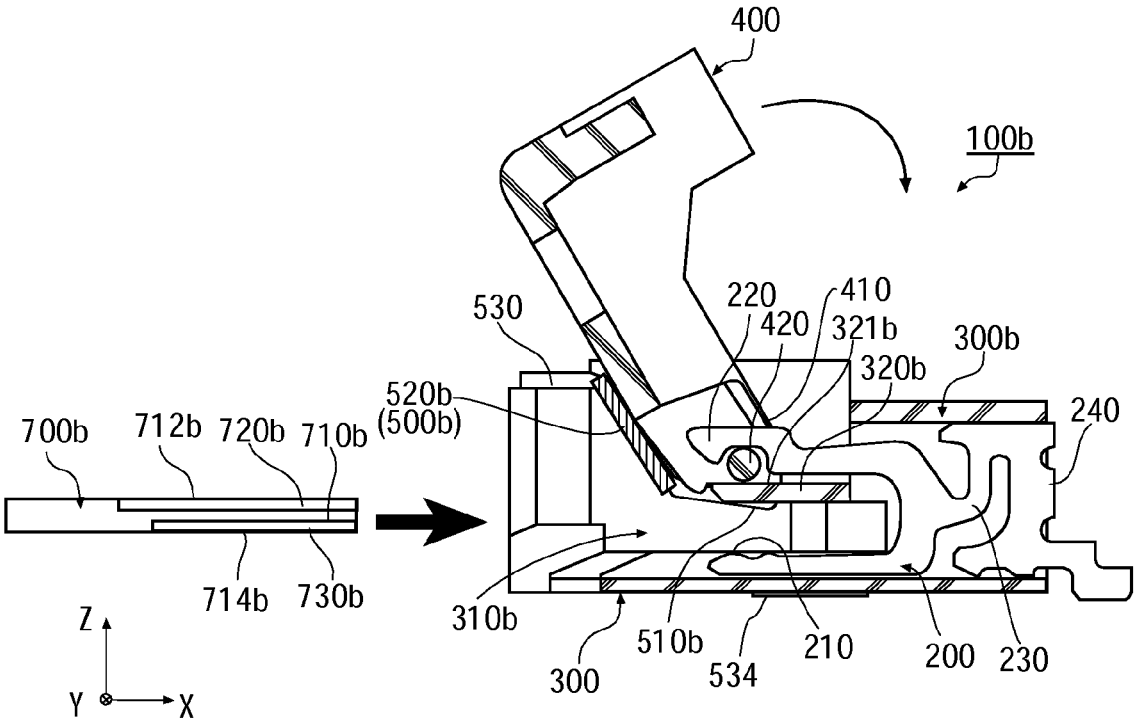
FIG. 10 A cross-sectional view showing the connector of the second embodiment of the present invention. The connector includes the ground member of FIG. 8. The actuator is positioned at the first rotation position.
Figure 11:
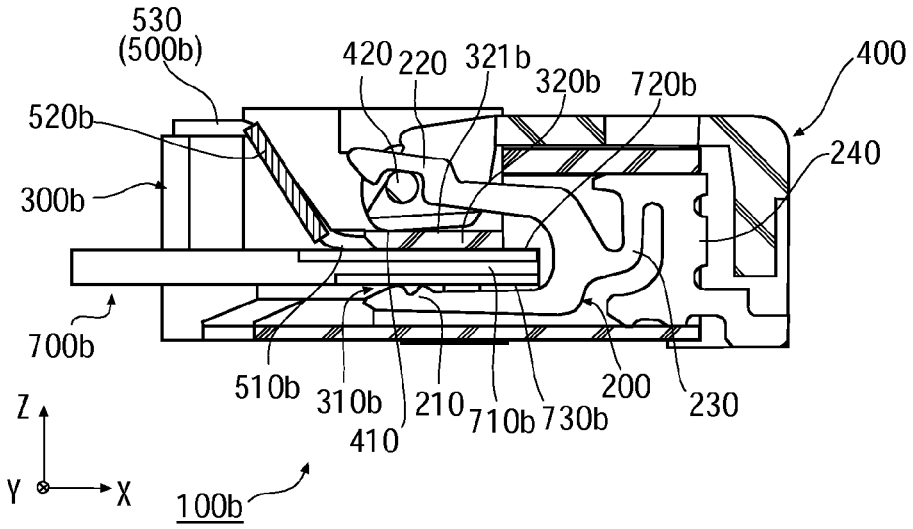
FIG. 11 A cross-sectional view showing the connector of FIG. 10. The actuator is positioned at the second rotation position.

As understood from FIG. 8 to FIG. 11, a separator portion 320*b* of a housing 300*b* is formed with a plurality of slits (not shown). The plurality of slits extends in the X-direction. The slits are provided with a space therebetween in the Y-direction and correspond to the ground contacts 510*b*, respectively. The ground contacts 510*b* are partially positioned in the corresponding slits when the ground member 500*b* is attached to the housing 300*b*. In detail, as illustrated in FIG. 10, the ground contact 510*b* is partially positioned in an accommodation portion 310*b* when an end portion 710*b* of an FPC/FFC 700*b* is not accommodated in the accommodation portion 310*b*. Similar to the first embodiment, the end portion 710*b* of the FPC/FFC 700*b* is accommodated in the accommodation portion 310*b*. When the actuator 400 is brought into the rotation operation, the push portion 410 pushes a pushed surface 321*b* so that the contact portion 210 is pushed against the signal layer 730*b*. The ground layer 720*b* is pushed against the separator portion 320*b* and lift the ground contacts 510*b*. The lifted ground contacts 510*b* is brought into contact with the ground layer 720*b*.

The ground contact 510*b* does not establish a surface contact with the ground layer 720*b* of the FPC/FFC 700*b*. In other words, the ground contacts 510*b* are displaced while the plate-like portion 510 of the first embodiment (see FIG. 6) is fixed. However, stress applied to the FPC/FFC 700*b* by the ground contact 510*b* of the present embodiment is exceedingly smaller than stress applied to the FPC/FFC 700*b* by the actuator 400 of the conventional type. Thus, in the connector 100*b* of the present embodiment, a stable contact between the contact portion 210 and the signal layer 730*b* can be obtained as compared to the conventional connector.

The plate-like portion 510 or the ground contact 510*b*, the actuator-receiving portion 520(520*b*) and the hold downs 534 are formed integrally with each other in the ground member 500, 500*b* of the above-described embodiment of the present invention. However, the hold downs 534 may be formed separately. Each of the hold downs 534 formed separately may be press-fitted into the housing 300(300*b*) so as to be held by the housing 300(300*b*).

DESCRIPTION OF NUMERALS

100, 100*a*, 100*b* Connector
200 Contact
210 Contact portion
220 Force receiving portion
230 Supporting portion
240 Fixed portion
300, 300*b* Housing
310, 310*b* Accommodation portion
320, 320*b* Separator portion
321, 321*b* Pushed surface
400 Actuator
420 Lift portion
500, 500*b* Ground member
510 Plate-like portion
510*b* Ground contact
520, 520*b* Actuator-receiving portion
521 Front side part
522 Rear side part
530 End portion
532 Press-fit portion
534, 540 Hold down
700, 700*b* FPC/FFC (connection object)
710, 710*b* End portion
712 Top surface
714 Bottom surface
720 Ground layer
730 Signal layer

The invention claimed is:

1. A connector comprising an accommodation portion, a plurality of contacts, a housing, and an actuator, wherein:

the accommodation portion accommodates an end portion of a connection object;

each of the plurality of contacts comprises a contact portion, a force receiving portion, a support portion, and a fixed portion;

the contact portion is positioned in the accommodation portion;

the force receiving portion forms a bifurcated shape together with the contact portion;

the support portion elastically supports a boundary part between the contact portion and the force receiving portion;

the fixed portion is connected with the support portion;

the contact portion, the force receiving portion, and the support portion are deformable and displaceable in an up-down direction perpendicular to an insertion direction of the connection object;

the housing comprises a separator portion, and the housing holds the actuator and arranges the plurality of contacts in a left-right direction perpendicular to the insertion direction and the up-down direction by holding each of the fixed portions of the plurality of contacts;

the separator portion is positioned between the contact portion and the force receiving portion and comprises a part of the accommodation portion;

the actuator comprises a lift portion and is rotatable between a first rotation position and a second rotation position;

the lift portion is positioned between the separator portion and the force receiving portion in the up-down direction;

when the actuator is rotated from the first rotation position to the second rotation position, the lift portion lifts the force receiving portion so that the contact portion is pushed against a bottom surface of the end portion of the accommodated connection object;

the end portion of the connection object comprises a top surface and a bottom surface;

the top surface is formed with a ground layer;

the bottom surface is formed with a signal layer;

the connector further comprises a ground member;

the ground member is held by the housing;

at least a part of the ground member is positioned in the accommodation portion when the end portion of the connection object is not accommodated in the accommodation portion; and the contact portion is pushed against the signal layer according to the rotation of the actuator, the contact portion is brought into contact with the signal layer, and the ground layer is pushed against a part of the ground member.

2. The connector as recited in claim 1, wherein:

the ground member comprises a plate-like portion;

the plate-like portion is provided under the separator portion and extends in the left-right direction; and when the contact portion is pushed against the signal layer, the plate-like portion is pushed against the separator portion by the ground layer so that the plate-like portion is connected with the ground layer.

3. The connector as recited in claim 1, wherein:

the ground member comprises a plurality of ground contacts;

the plurality of ground contacts are provided with respective spaces therebetween in the left-right direction;

the separator portion is formed with a plurality of slits;

the plurality of slits extend in the insertion direction and respectively correspond to the plurality of ground contacts;

each of the plurality of ground contacts is partially positioned in its corresponding slit;

when the end portion of the connection object is not accommodated in the accommodation portion, each of the plurality of ground contacts is partially positioned in the accommodation portion; and when the contact portion is pushed against the signal layer, the plurality of ground contacts are lifted by the ground layer such that each of the plurality of ground contacts is connected with the ground layer.

4. The connector as recited in claim 1, wherein:

the ground member further comprises an actuator-receiving portion;

the actuator-receiving portion extends in the left-right direction and comprises a front side portion and a rear side portion; and when the end portion of the connection object is inserted in the accommodation portion, the rear side portion receiving the actuator is positioned at the first rotation position while the front side portion guides the end portion.

5. The connector as recited in claim 1, wherein the ground member comprises hold downs, and the hold downs are connected with the ground layer.

6. The connector as recited in claim 1, wherein:

the separator portion comprises a pushed surface;

a positional relation between the separator portion and the connector is fixed;

the actuator further comprises a push portion;

the push portion pushes the pushed surface of the separator portion when the actuator is rotated from the first rotation position to the second rotation position; and the push portion receives a reaction force by the pushed surface and moves the lift portion upward.

* * * * *

UNITED STATES PATENT AND TRADEMARK OFFICE

CERTIFICATE OF CORRECTION

PATENT NO. : 8,622,766 B2
APPLICATION NO. : 13/499591
DATED : January 7, 2014
INVENTOR(S) : Hiroyuki Yokoo et al.

It is certified that error appears in the above-identified patent and that said Letters Patent is hereby corrected as shown below:

In the Specification

Column 1, Line 58:

delete “portion” and insert --portion,--.

Column 4, Line 34:

delete “direction” and insert --Z-direction--.

Column 4, Line 57:

delete “end,” and insert --end--.

Signed and Sealed this
Seventeenth Day of June, 2014

Michelle K. Lee

Michelle K. Lee
*Deputy Director of the United States Patent and Trademark Office*